US005526870A

United States Patent [19]

Ødegård et al.

[11] Patent Number: 5,526,870

[45] Date of Patent: Jun. 18, 1996

[54] LEVEL CONTROL SYSTEM FOR CONTINUOUS OR SEMI-CONTINUOUS METAL CASTING EQUIPMENT

[75] Inventors: Magne Ødegård, Ålvundeid; Jan Sivertsen, Grøa, both of Norway

[73] Assignee: Norsk Hydro a.s., Oslo, Norway

[21] Appl. No.: 404,099

[22] Filed: Mar. 14, 1995

[30] Foreign Application Priority Data

Mar. 18, 1994 [NO] Norway ..... 941000

[51] Int. Cl.[6] ..... B22D 11/16; B22D 11/18

[52] U.S. Cl. ..... 164/449.1; 164/453; 164/151.3; 164/151.2

[58] Field of Search ..... 164/449.1, 453, 164/151.3, 151.2

[56] References Cited

U.S. PATENT DOCUMENTS 4,304,287 12/1981 Lavanchy et al. ..... 164/4.1

5,339,885 8/1994 Sinden et al. ..... 164/151.2

FOREIGN PATENT DOCUMENTS 56-91974 7/1981 Japan ..... 164/449.1

4-262843 9/1992 Japan ..... 164/449.1

2087682 5/1982 United Kingdom .

2232104 12/1990 United Kingdom .

*Primary Examiner*—Jack W. Lavinder

*Assistant Examiner*—I.-H. Lin

*Attorney, Agent, or Firm*—Wenderoth, Lind & Ponack

[57] ABSTRACT

A level control system controls the level of molten metal in continuous or semi-continuous casting equipment, for example casting equipment for production of roll ingots or billets of aluminum. The casting equipment includes a casting mold with an upper open filling hole for receipt of molten metal from a supply gutter or the like having an outlet above the filling hole. The level of the metal is controlled by a PLC unit as a function of a signal from a radar sensor which detects the level of the metal as the metal supply is controlled by a closing arrangement regulated by an actuator as a function of signals from the PLC unit.

5 Claims, 1 Drawing Sheet

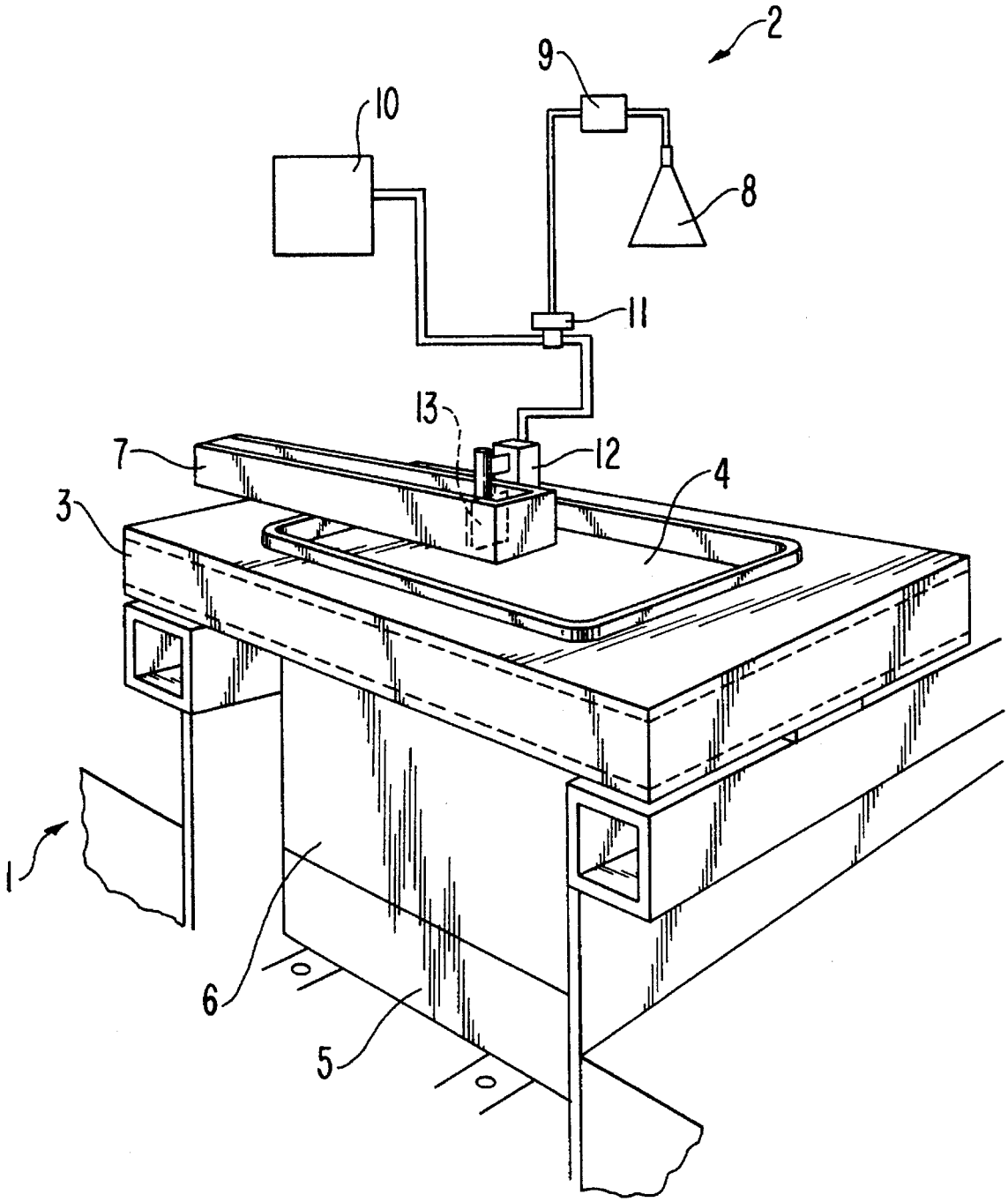
2
9
10
8
11
13
12
7
4
3
1
6
5

LEVEL CONTROL SYSTEM FOR CONTINUOUS OR SEMI-CONTINUOUS METAL CASTING EQUIPMENT

BACKGROUND OF THE INVENTION

The present invention relates to a level control system for controlling the metal level in continuous or semi-continuous casting equipment, for instance casting equipment for the production of billets or ingots of aluminum, which casting equipment includes a casting mold with an upwardly open supply opening for receiving molten metal and a supply gutter or the like, with an outlet arranged above the supply opening for transfer of the molten metal from a holding furnace or the like.

When casting metal continuously or semi-continuously as mentioned above, a metal flow control system based on the use of floats is most commonly used today. This system possesses limited possibilities of controlling the level of molten metal during the casting operation and no possibilities to control supply of molten metal during start-up of the casting operation. Besides, the control for such a system is slow, which, inter alia, results in an uneven quality of the cast metal body. Especially when casting roll ingots, the metal supply at the starting of casting and thereby the level of molten metal in the casting mold is of very great importance, since most of the problems which arise at later stages of casting are caused by these initial conditions.

SUMMARY OF THE INVENTION

The present invention provides a level control system which achieves even and rapid control of the supply of molten metal during all the phases of the casting operation, which is dependable and easy to use and which can be preprogrammed in such a way that, at any time during the casting operation, optimal casting conditions are obtained. This results in a number of advantages, as follows:

—During casting with several casting molds, it is possible to achieve the same metal amounts and filling rates in all the casting molds.

—The same filling rate from one cast to another.

—Equal metal levels in the molds at start-up from one cast to another.

—An even filling rate in the casting mold provides improved metal distribution against the casting shoe, which in turn improves heat transfer from the cast material to the casting shoe and that is the same from one cast to another. This will also affect the shrinking tendency and thereby ensure that the cast material is in a stable position on the casting shoe.

—Less danger of solid contraction and crack initiation.

—Less danger of surface oxides which can initiate formation cracks.

—Less danger of accidents.

The invention provides that the level of the metal is controlled by a PLC unit as a function of a signal from a radar sensor which registers the level of the upper surface of the metal, as the metal supply is controlled by an actuator operated closing arrangement as a function of signals from the PLC unit.

BRIEF DESCRIPTION OF THE DRAWING

The invention will not be further described by means of examples and with reference to the attached drawing which is a perspective schematic view, partially in section, of a semi-continuous casting equipment or apparatus for the production of roll ingots and including a level control system for controlling the metal level in the casting equipment.

DETAILED DESCRIPTION OF THE INVENTION

A casting equipment or apparatus I includes, a casting mold 3 with an upwardly open supply opening 4 for molten metal, at a bottom side of the casting mold, on a vertically movable support 5, a casting shoe 6. Molten metal is filled into the casting mold through a gutter 7 or the like which is provided in connection with a holding furnace which can be tilted (not shown).

A level control system 2 includes a radar sensor 8, a PLC (programmable logic control) 9, a hydraulic aggregate 10, a proportionality or servo valve 11 and a hydraulic actuator 12. The radar sensor 8 which includes an antennae (not shown) is provided above the casting equipment, at a distance therefrom, and is arranged to measure the distance to the plane of the upper surface or level of the molten metal in the metal supply opening 4. Preferably, the radar sensor is provided at some distance from the casting equipment, for instance in the ceiling of the building where the equipment is disposed. Thereby, it will not be in the way during the casting operation or during operations on the casting equipment, for instance in connection with maintenance of the equipment. Besides, with such distance positioning of the radar sensor, the sensor will be prevented from being damaged by the hot metal. The use of a radar sensor as a distance meter therefore represents an essential advantage of the invention.

The radar sensor, i.e. the antennae, generates a modulated microwave signal and receives a reflected signal from the metal surface. The reflected signal is demodulated, filtered for unwanted reflections and analyzed by a microprocessor in the sensor, which in turn delivers an electrical signal to the PLC unit representative of the level of the upper plane of the metal. The accuracy of such measurement by the radar sensor is by testing found to be better than ±0.5 mm.

The molten metal supplied by the gutter 7 is regulated by a throttle valve 13 which reaches down into the gutter and which is moveable in the vertical direction by means of hydraulic actuator 12. The actuator constitutes hydraulic piston/cylinder unit which is driven by hydraulic oil from hydraulic aggregate 10. Actuator 12 has a built-in electronic position device in the form of a sensor (not shown) which generates a signal to the PLC unit 9 in accordance with the position of the piston and thereby the position of the throttle in the gutter. The supply of hydraulic fluid to the actuator 12 is regulated by proportionality valve or servo valve 11 which receives such electrical signal from the PLC unit 9.

The PLC unit 9 is the "brain" as such of the control system and can be programmed in such a way that the upper surface or plane of the molten metal at any time during the casting operation is kept at a level which is suitable to obtain an optimal casting result.

The control system in accordance with the invention operates as follows. When a casting operation is starting, the throttle valve 13 opens in the gutter 7 by means of the actuator 12 such that molten metal in a desired amount can flow down into the supply opening 4 of the casting mold 3. The level of the upper plane of the metal in the casting mold opening 4 is detected by the radar sensor 8 which continuously transmit signals representative thereof to the PLC unit 9. From the beginning of and during the entire casting operation, the PLC unit 9 transmits electrical signals to the servo valve 11 which in turn affects the hydraulic fluid supply to the actuator 12 in such a way that actuator 12 thus controls the position of the throttle valve 13 in the gutter 7 in accordance with the suitable metal flow. The hydraulic actuator 12 continuously delivers to PLC unit 9 signals regarding the position of the throttle valve 13 in the gutter 7.

The radar sensor 8, in addition to be used for detecting the level of the upper surface of the metal can also be used for recording of the position (height) of the casting shoe 6 relative to the casting mold, prior to starting of the casting operation. This represents another essential advantage of the invention which prevents water penetration into the shoe and damage to the equipment and prevents metal leakage.

The invention as defined in the claims is not in any way limited by the example which is shown in the drawing and described above. Thus, an electrically driven actuator may be used instead of the hydraulically driven actuator. A hydraulic actuator is, however, preferred since it is less sensitive to high temperatures (heat). Further, a nozzle/needle arrangement, wherein the actuator moves a needle which reaches down into a nozzle orifice in the gutter, may be used instead of a closing arrangement in the form of throttle valve 13. Besides, the PLC unit, in addition to controlling the level of the upper surface of the molten metal, may, as an integrated function, be used to control the filling position of the holding furnace. This could be done utilizing the PLC unit to control a servo valve in a hydraulic system which in turn could control the tilting of the holding furnace in accordance with the necessary flow of metal in the gutter.

We claim:

1. A level control system for controlling the level of metal in a continuous or semi-continuous casting apparatus including a mold with an upwardly open supply opening for receiving molten metal from a supply device having an outlet arranged above the supply opening, and a closing arrangement operable to relatively close and open the outlet, said level control system comprising:

a radar sensor positionable to detect the level of an upper surface of metal in the supply opening of the mold and to generate a signal representative thereof;

a hydraulically operated actuator to be coupled to the closing arrangement to initiate operation thereof;

a proportionality valve or servo valve connected to regulate supply of hydraulic fluid to said actuator to regulate operation thereof; and a programmable logic control unit in operable communication with said radar sensor to receive said signal therefrom and in operable communication with said proportionality valve or servo valve to control operation thereof as a function of said signal received from said radar sensor.

2. A system as claimed in claim 1, wherein said radar sensor is operable to be mounted fixedly and to detect the metal level without being movable relative to the mold.

3. An apparatus comprising said system as claimed in claim 1, and said closing arrangement coupled to said actuator.

4. An apparatus as claimed in claim 3, wherein said closing arrangement comprises a throttling valve operable by said actuator.

5. An apparatus as claimed in claim 3, wherein said closing arrangement comprises a needle valve member.

* * * * *